US007445118B2

(12) United States Patent
Schroeder

(10) Patent No.: US 7,445,118 B2
(45) Date of Patent: Nov. 4, 2008

(54) HOLDER TO FACILITATE THE SIGNALING AND STORAGE OF COLLECTIBLE BASEBALLS AND OTHER SPORTS MEMORABILIA

(76) Inventor: James Schroeder, 32 Hillside Ave., Teaneck, NJ (US) 07666-4060

( * ) Notice: Subject to any disclaimer, the term of this patent is extended or adjusted under 35 U.S.C. 154(b) by 225 days.

(21) Appl. No.: 10/553,701

(22) PCT Filed: Sep. 13, 2004

(86) PCT No.: PCT/US2004/029754

§ 371 (c)(1),
(2), (4) Date: Oct. 17, 2005

(87) PCT Pub. No.: WO2006/031225

PCT Pub. Date: Mar. 23, 2006

(65) Prior Publication Data

US 2007/0051658 A1 Mar. 8, 2007

(51) Int. Cl.
*B65D 85/00* (2006.01)

(52) U.S. Cl. ..... 206/579; 206/315.9

(58) Field of Classification Search ..... 206/579, 206/224, 315.1, 315.9, 315.91, 775, 779, 206/486

See application file for complete search history.

(56) References Cited

U.S. PATENT DOCUMENTS

| | | | | |
|---|---|---|---|---|
| 5,379,892 | A | 1/1995 | Reams et al. | |
| 6,016,910 | A | 1/2000 | Rodearmel | |
| 6,644,473 | B2 * | 11/2003 | Kohler | 206/315.9 |
| 2002/0084201 | A1 * | 7/2002 | Murray | 206/315.9 |

* cited by examiner

*Primary Examiner*—Jacob K. Ackun, Jr.
(74) *Attorney, Agent, or Firm*—Patrick P. Zaretski

(57) ABSTRACT

An apparatus and method of use thereof, to assist in the signing and protection of sports memorabilia articles while on the field of play. Means for attaching or holding a writing implement is provided on the apparatus. The main body of the apparatus, preferably constructed from plastic, is contoured to facilitate griping the apparatus while a player is signing the article. In alternative embodiments, the apparatus may be constructed in a two-piece, interlocking design to permit multiple uses. The apparatus may also bear graphical information for advertising, identification, or other informational uses.

45 Claims, 18 Drawing Sheets

HOLDER TO FACILITATE THE SIGNALING AND STORAGE OF COLLECTIBLE BASEBALLS AND OTHER SPORTS MEMORABILIA

TECHNICAL FIELD OF THE INVENTION

This invention relates to collectible memorabilia holders, and more particularly to an apparatus, and method of use thereof, for holding a baseball or other sports memorabilia article in such a way as to facilitate its signing for autographs and/or later storage.

BACKGROUND ART

Since the dawn of professional sports, it has been common among sports fans, athletes, and others to display sports memorabilia, such as autographed baseballs. While it is of course possible to have players autograph baseballs at sports memorabilia stores, or other locations, a significant number of autograph signings occur at the baseball field prior to a game's start, when players practice and interact with the fans. Nevertheless, this informal and impromptu signing procedure presents a number of problems to both the signing player and the fan.

First, as the player usually does not return to the field from practice but is likely to sign the balls before leaving, he will likely still have on equipment like batting gloves or mitts, which become dirty through game play and which are themselves cumbersome to have to hold on to while also signing a baseball. Additionally, the sweat from a player's hands after a vigorous practice can itself damage the baseball, either by dirtying the surface of an unsigned ball or smearing other signatures on a baseball signed by more than one player. Such scuffing and dirtying of the baseball is of course highly deleterious to its aesthetic and monetary or collectible value. It would therefore be desirable for a fan or baseball collector desiring to have a signed baseball clean from dirt and other field debris to provide the player with a ball which is at least partly clean of such dirt or debris.

Next, as stated previously, the signing player is signing a baseball standing on the field of play while carrying his mitt. Oftentimes the player will be straining for any type of leverage against which he can more easily grip or sign the ball. Many players who would be agreeable to signing a baseball might nevertheless choose not to do so because of these practical obstacles in physically signing the ball. It would therefore be desirable for both a fan or baseball collector and a signing player to provide that player with some form of leverage to assist the player in physically signing the ball while standing.

Finally, many times a player who would be willing to sign a baseball is stymied in his attempt because he does not have a pen. Given the short amount of time a player has between the end of practice and having to depart the field, waiting for a fan to produce a pen is not something a player wishes to do. Also, many times a casual fan does not possess a pen but would still like to have a genuine autographed baseball. It would therefore be desirable for both a fan or baseball collector and a signing player to provide that player with simultaneously with both a baseball to be signed and a pen for the player to use in one convenient package.

A survey of the prior art reveals many devices useful for storing and displaying signed sports memorabilia, which are advantageous to the fan or collector by preventing a viewer from directly handling the memorabilia and thereby damaging the piece, and by protecting the piece from environmental degradation. Thus, U.S. Pat. No. 6,016,910 to Rodearmel describes and claims a device for displaying sports memorabilia having a base member and a memorabilia holder extending outwardly from a display surface of the base member. A music box may also be mounted to the base member, and at least one of the base member, holder or music box comprises indicia such as shapes, decorations, and sounds related to the sport of the memorabilia to provide an enhanced sensory experience for the viewer. Additionally, U.S. Pat. No. 5,379,892 to Reams, et al., describes and claims a protective display case for collectible items such as baseballs and other collectible items, comprising a rigid transparent tube which contains the baseballs and through which they can be viewed; one end cap at each end of the transparent tube to retain the balls; and a rigid backboard to which the end caps are attached for the purpose of holding the end caps in their fixed rigid position. However, while each of these devices indeed helps protect and display the signed baseballs, none of these in any manner facilitates the initial signing of the baseball.

OBJECTS OF THE INVENTION AND INDUSTRIAL APPLICABILITY

Accordingly, it is a general object of the present invention to provide an apparatus, and method of use thereof, to aid in the signing and protection of baseballs and other sports memorabilia articles while on the field of play.

It is an object of the present invention to provide an apparatus, and method of use thereof, to aid in the signing and protection of baseballs and other sports memorabilia articles whereby the baseball is protected from being dirtied by the signing player's hands, equipment, or other debris or material while on the field of play.

It is a further object of the present invention to provide an apparatus, and method of use thereof, to aid in the signing and protection of baseballs and other sports memorabilia articles whereby the device provides the player with some form of leverage to assist the player in physically signing the ball while standing on the field of play.

It is a still further object of the present invention to provide an apparatus, and method of use thereof, to aid in the signing and protection of baseballs and other sports memorabilia articles whereby the player is simultaneously provided on the field of play with both a baseball to be signed and a pen for the player to use in one convenient package.

SUMMARY OF THE INVENTION

Consequently, to achieve these and other aims and objectives, the present invention provides for an apparatus, and method of use thereof, to assist in the signing and protection of a baseball or other similar sports memorabilia article while on the field of play. The apparatus is to be constructed of plastic, although other durable material may be used. The apparatus consists of a top and bottom end configured as flat discs, or alternatively as a flat top end and an asymmetrically-curved bottom end, these ends linked by a central portion. The main body of the apparatus is hollow from the top end through the central portion continuing into the bottom end, providing holes of a circumference large enough to accept a baseball or other similar sports memorabilia article. Means for attaching or holding a writing implement is provided on the main body of the apparatus through a hole formed from a flange extending outwardly from the central portion of the apparatus, alternatively from holes drilled through the top and bottom ends, or from a hole drilled through the top end with a holder affixed to or molded from the material forming the bottom end. The central portion of the main body of the apparatus may be contoured and tapered to facilitate gripping of the apparatus while a player is signing the article, and in an alternative embodiment, the bottom end of the apparatus has concave flanges to further facilitate such gripping. In a second alternative embodiment, the apparatus may be constructed in a two-piece, interlocking design to permit multiple uses. The apparatus may also bear lettering or logos for advertising, identification, or other informational uses on the top or bottom ends or on the central portion.

DETAILED DESCRIPTION OF THE INVENTION

Figure 1:
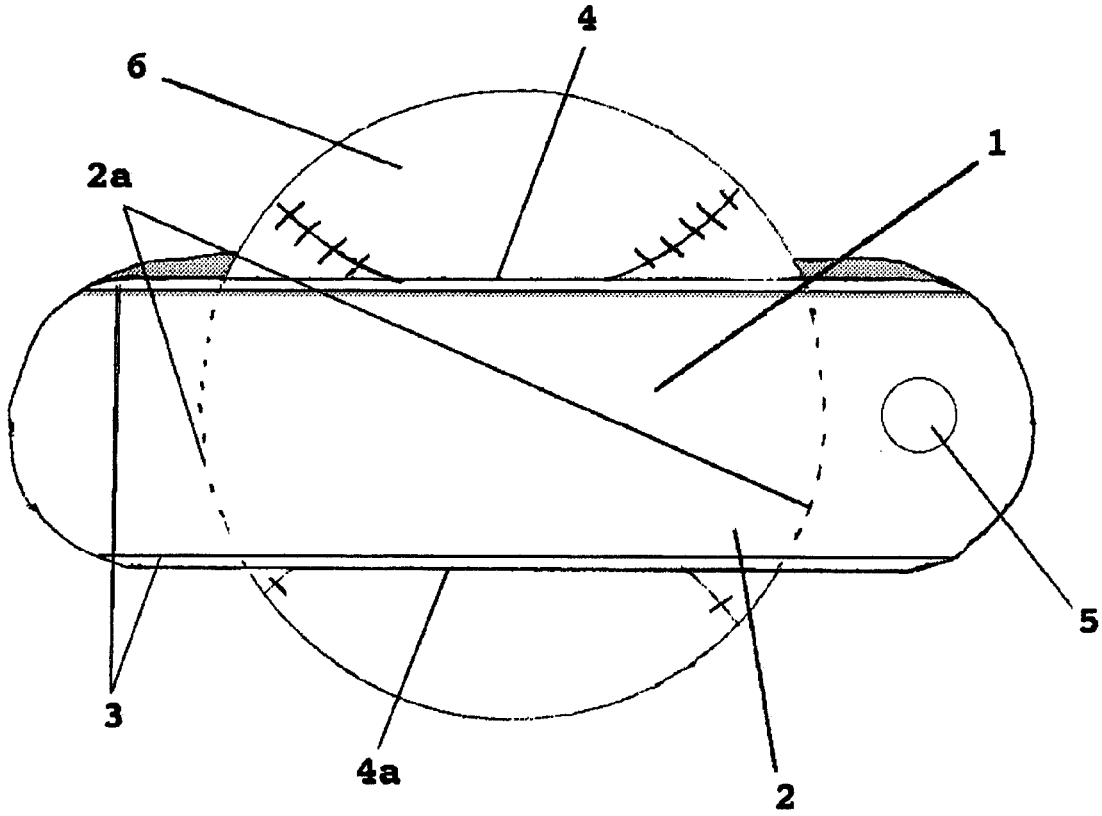
FIGS. 1 and 2 show a front and top view, respectively, of one embodiment of the apparatus with a baseball inserted therein.

There is depicted in FIG. 1 an apparatus 1 to be used to aid in the signing and protection of a baseball 6 or other sports memorabilia article while on the field of play. The apparatus 1 is preferably to be constructed from plastic; however, any other type of durable material may be used. The main body of the apparatus 1 consists of a central portion 2 from which two flanges 3 project outwardly laterally. The central portion 2 is hollowed out at ends 2*a* to form a space to accept a baseball 6 or other appropriately sized sports memorabilia article. The apparatus 1 has top and bottom ends 4 and 4*a* which extend the entire length of the central portion 2 and the lateral flanges 3. The top and bottom ends 4 and 4*a* each bear a slight lip 4*c* visible in FIG. 5. As a baseball 6 under Major League Baseball rules can have a circumference of no less than 9 inches (") and no greater than 9.25", the hollowed-out space in the central portion 2 must measure no greater or lesser than these dimensions, and also the top and bottom ends 4 and 4*a* are to have a greater circumference than these dimensions in order to best carry out the objectives of the present invention. Additionally, while the hollowed-out space in the central portion 2 may be completely flush with the baseball 6 or other articles in some embodiments, other embodiments may be sized to permit slight rotation of the article enveloped therein, which allows for an autographing player to spin the ball to find the best surface on which to sign. Finally, in this general embodiment of the invention, a hole 5 is to be provided in one of the lateral flanges 3 to accept a writing implement such as a pen (undepicted).

Figure 2:
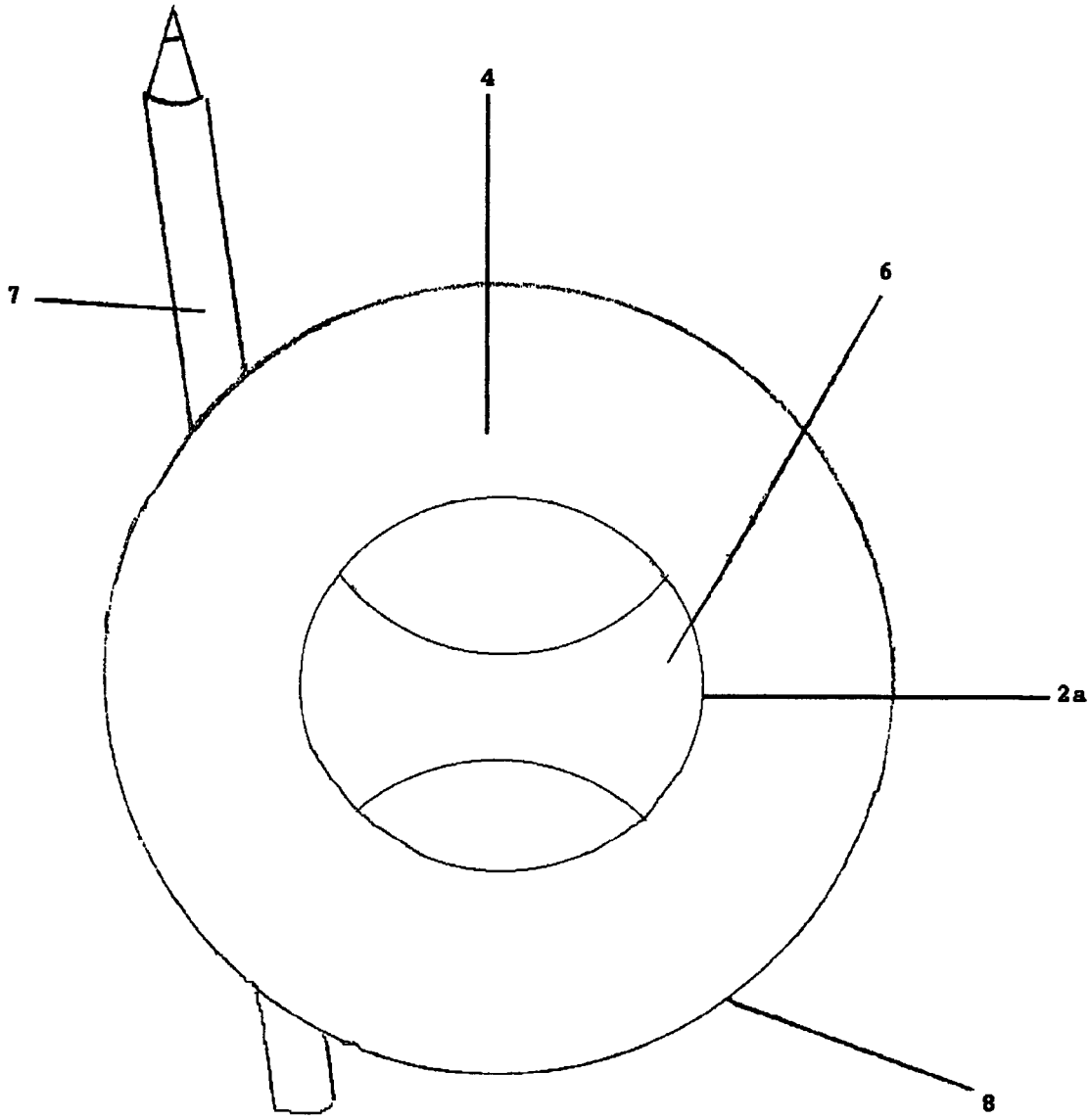

As seen in FIG. 2, the top end 4 of the apparatus 1 has a circumference significantly greater than that of the inserted baseball 6. The ends 2*a* of the central portion 2 wrap snugly around the baseball 6 to keep the ball in place. The outer edge 8 of the top end 4 is to be circularly shaped so as to facilitate a player's gripping the baseball 6. It is evident in this figure that a pen 7 has been inserted into the hole 5 illustrated in FIG. 1 to provide the autographing player with a writing implement on the field of play.

Figure 3:
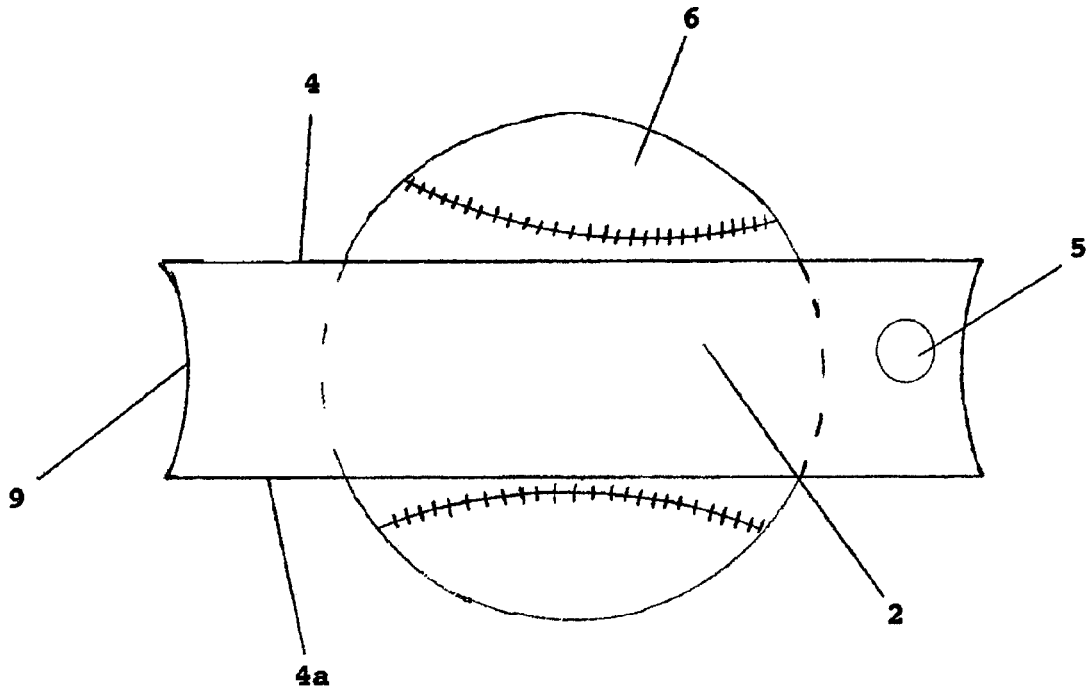
FIGS. 3, 4, and 5 show a front, cross-sectional, and front perspective view, respectively, of an alternative embodiment of the apparatus with a baseball inserted therein, this embodiment having concave flanges on the central portion of the main body of the apparatus.
Figure 4:
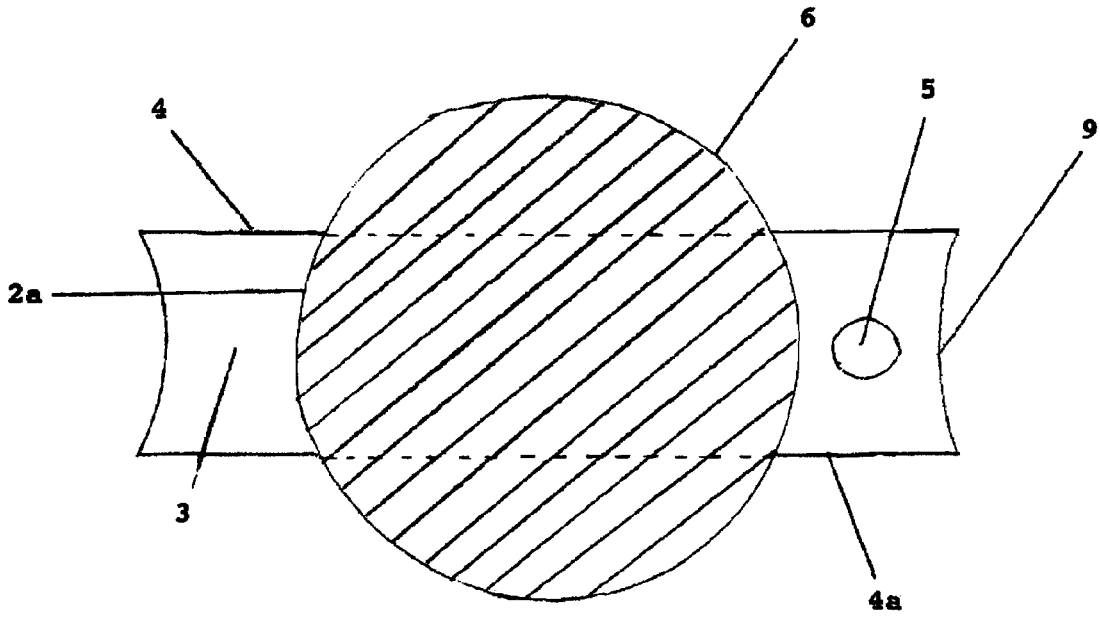
Figure 5:
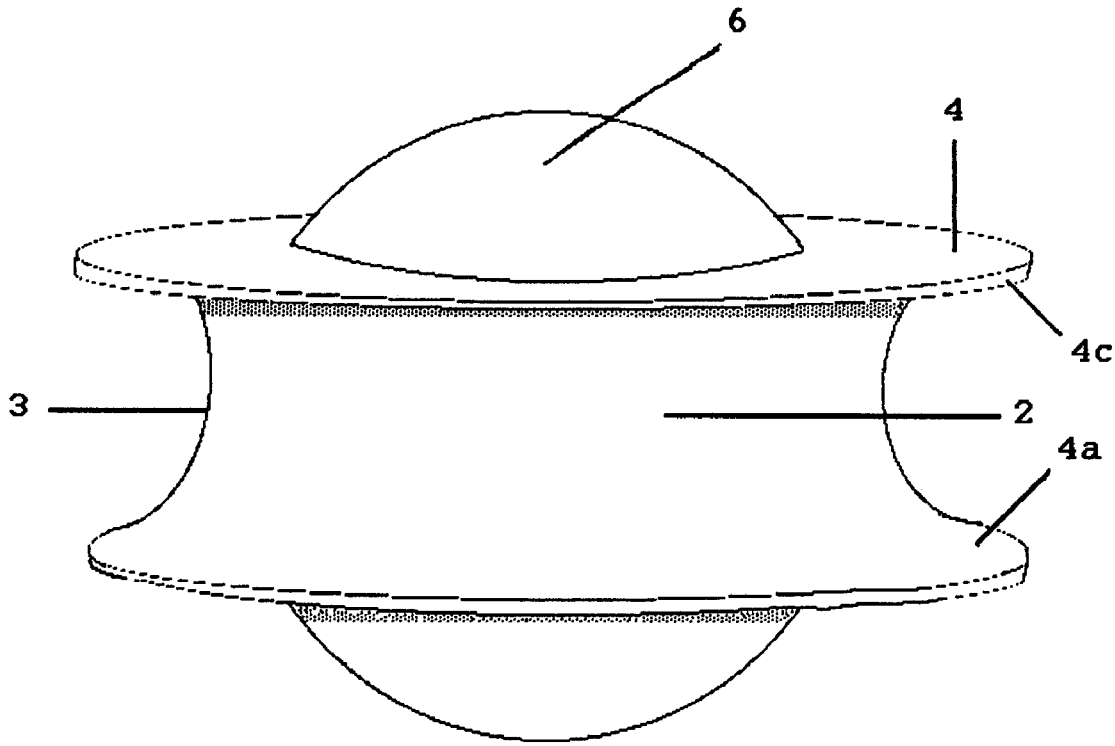

An alternative embodiment of the apparatus 1 is depicted in FIGS. 3, 4, and 5. In this embodiment, the lateral flanges 3 of the apparatus 1 are tapered concavely at their outer edges 9 in order to better fit into the autographing player's palm, thereby further strengthening his grip as he signs the baseball 6. As seen in FIG. 2, the ends 2*a* of the central portion 2 wrap snugly around the baseball 6 to keep the ball in place. Additionally in this embodiment, it is to be noted that the bottom end 4*a* of the apparatus is to remain parallel with the top end 4 along their entire length.

Figure 6:
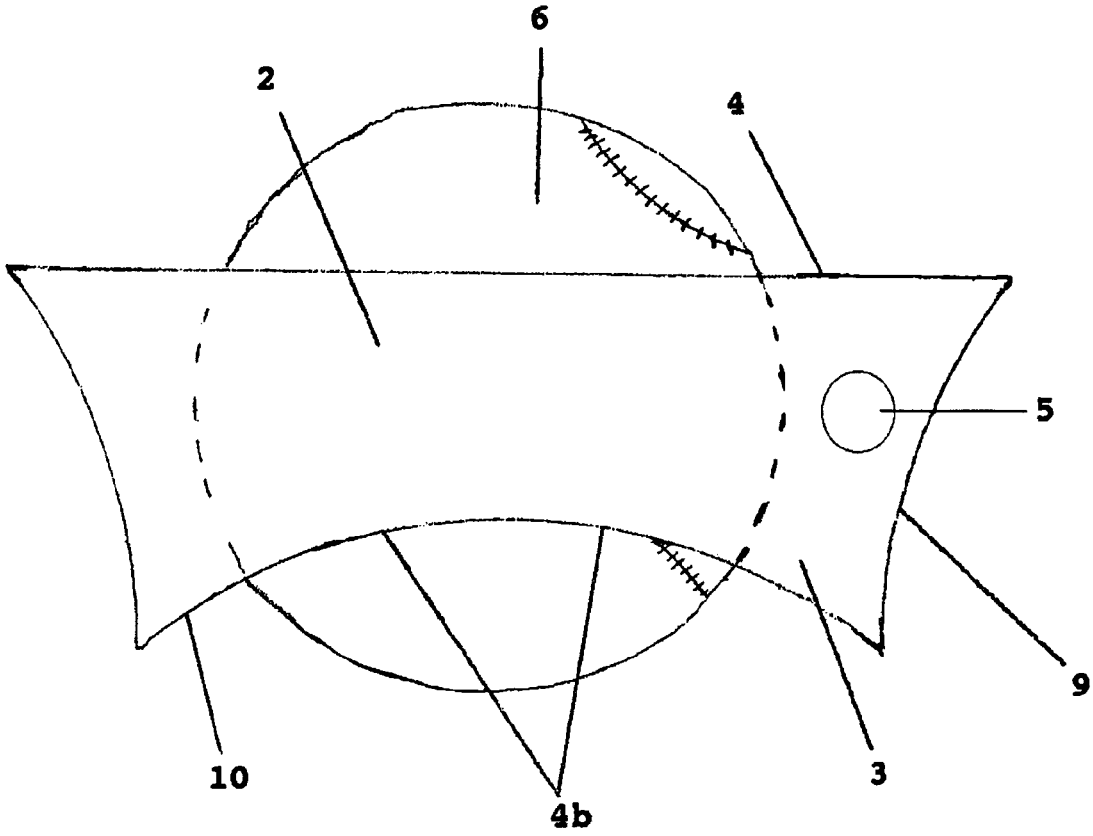
FIGS. 6 and 7 show a front and side view, respectively, of a second alternative embodiment of the apparatus with a baseball inserted therein, this embodiment having a concave flange on the bottom end of the main body of the apparatus.
Figure 7:
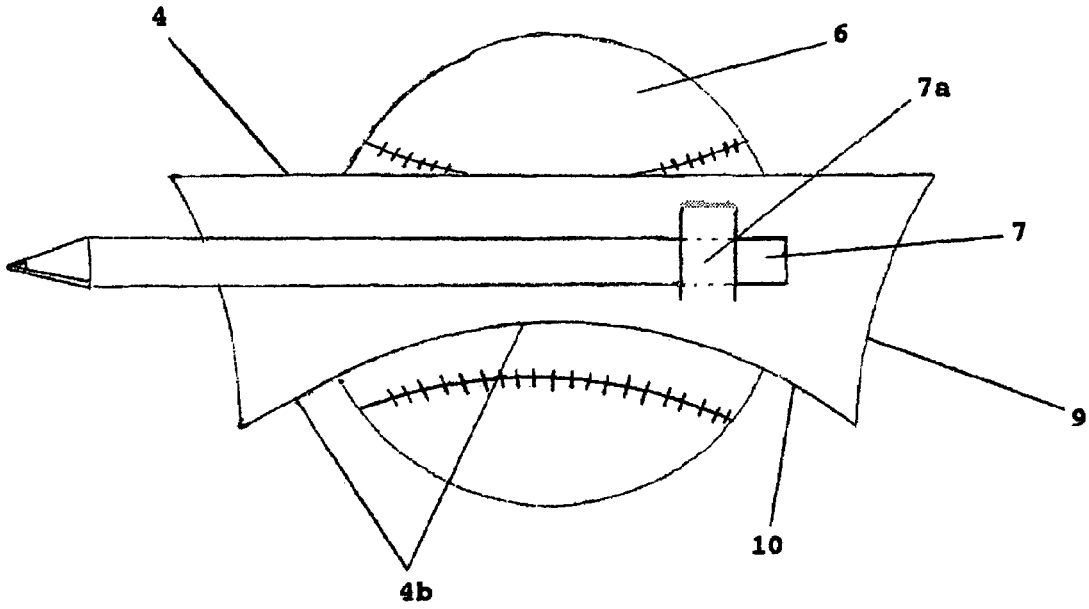

In FIGS. 6 and 7, an alternative embodiment of the apparatus 1 is illustrated. In this embodiment, the bottom end 4*b* of the apparatus 1 is tapered concavely inwardly towards the top end 4 to define two bottom flanges 10 projecting outwardly downwardly from each lateral flange 3. Along with the concavely-tapered edges 9 of the lateral flanges 3, the bottom flanges 10 of the apparatus 1 provide even further strengthening of an autographing player's grip as he signs a baseball 6 by supplying additional surface area for his palm to fit into. FIG. 5 further illustrates a writing implement 7, such as a pen, inserted into a holding space 7*a* formed by the hole 5 in the lateral flange 3. The total height of the apparatus 1 even with the tapered bottom end 4*b* should remain the same as in embodiments with straight bottom ends.

Figure 8:
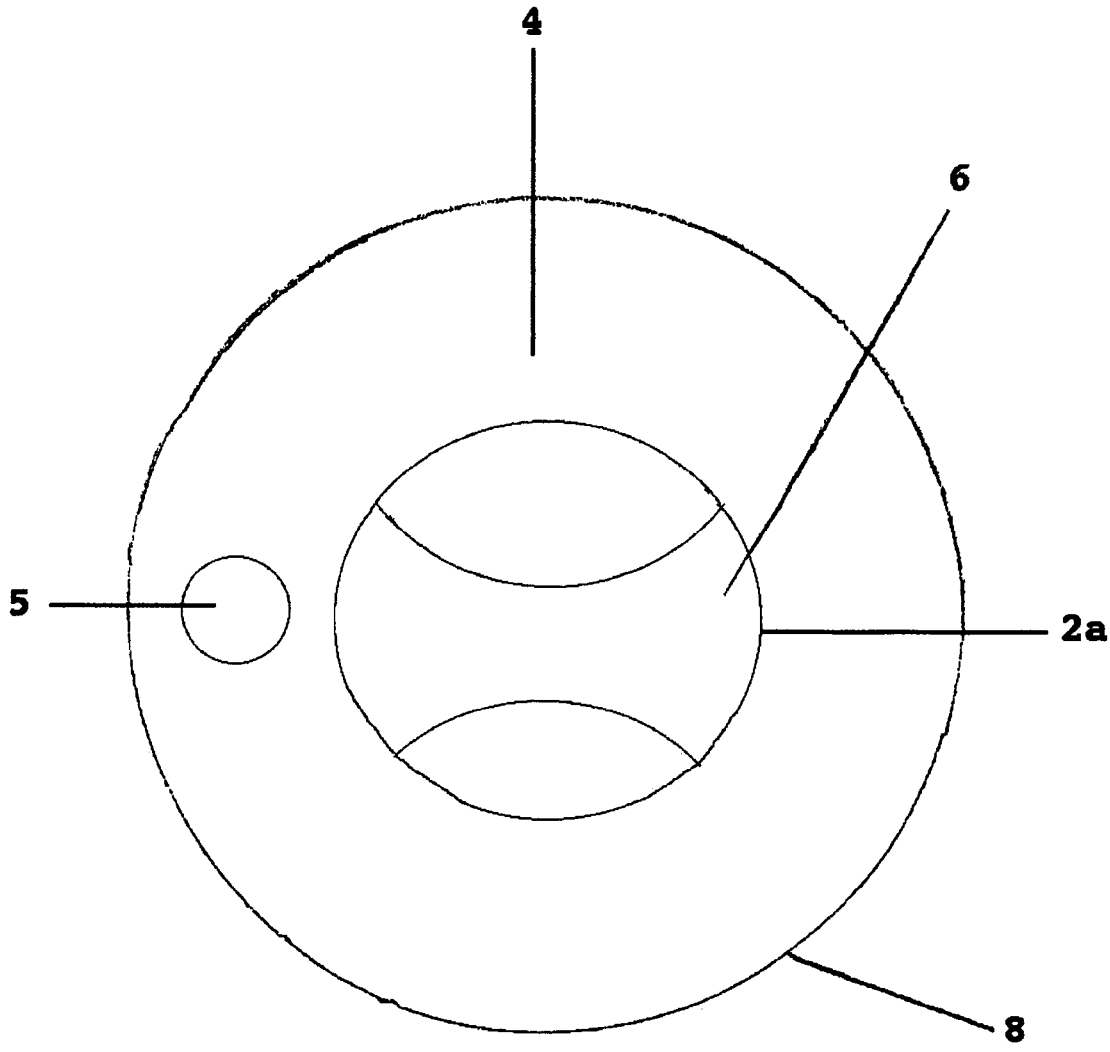
FIGS. 8, 9, and 10 show a top, side, and cross-sectional view, respectively, of an alternative embodiment of the apparatus wherein holes have been drilled through the top and bottom ends, and through the central portion of the main body, to accept the writing implement.
Figure 9:
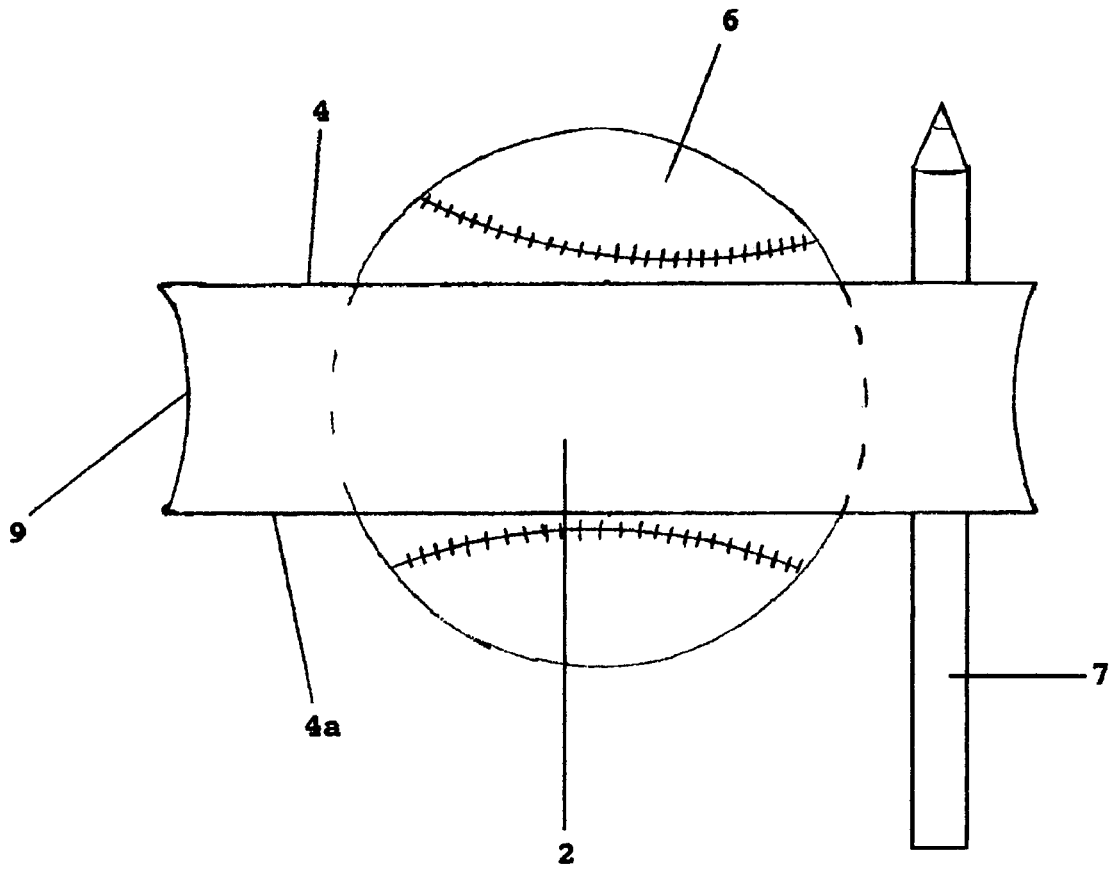
Figure 10:
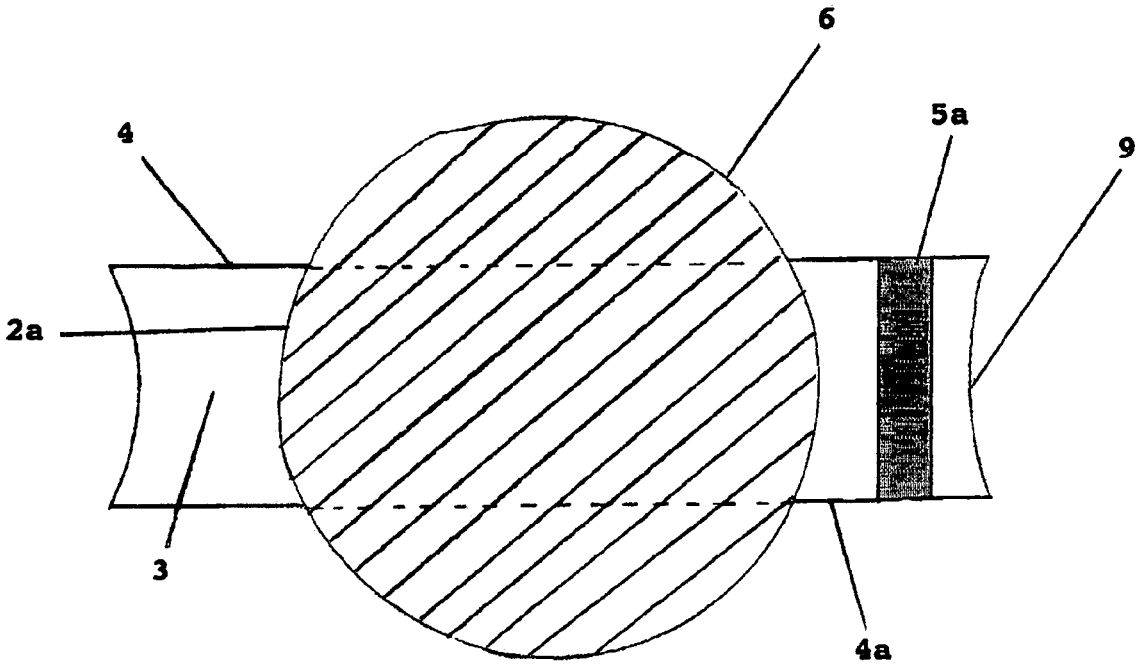

In FIGS. 8, 9, and 10, an alternative embodiment of the apparatus is illustrated wherein the hole 5 to accept the pen 7 has been drilled through both the top and bottom ends 4 and the central portion 2 of the apparatus 1. As seen in FIG. 10, a chamber 5*a* is formed by such drilling into which the pen 7 or other writing implement is inserted.

Figure 11:
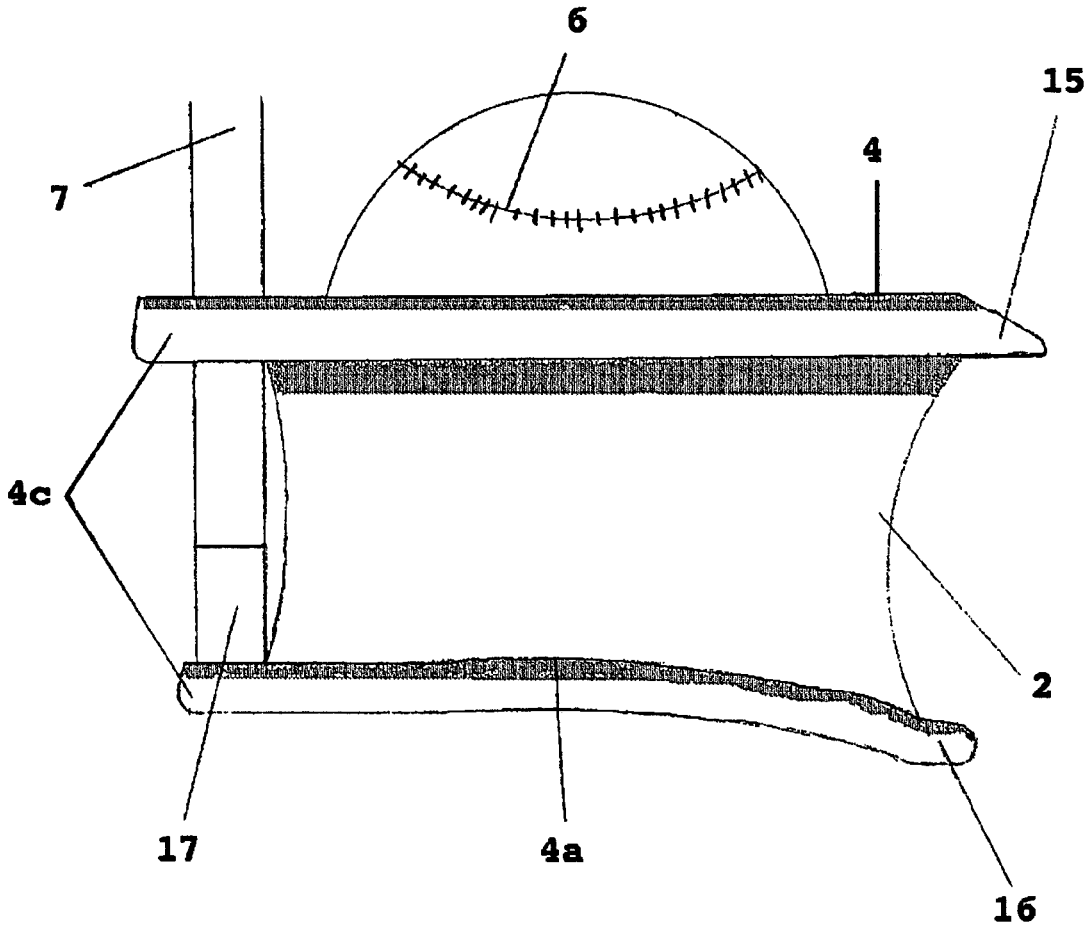
FIGS. 11 and 12 show a side and top view, respectively, of an alternative embodiment of the apparatus wherein the flat top end of the main body of the apparatus is proportionately larger than the asymmetrically-curved bottom end.
Figure 12:
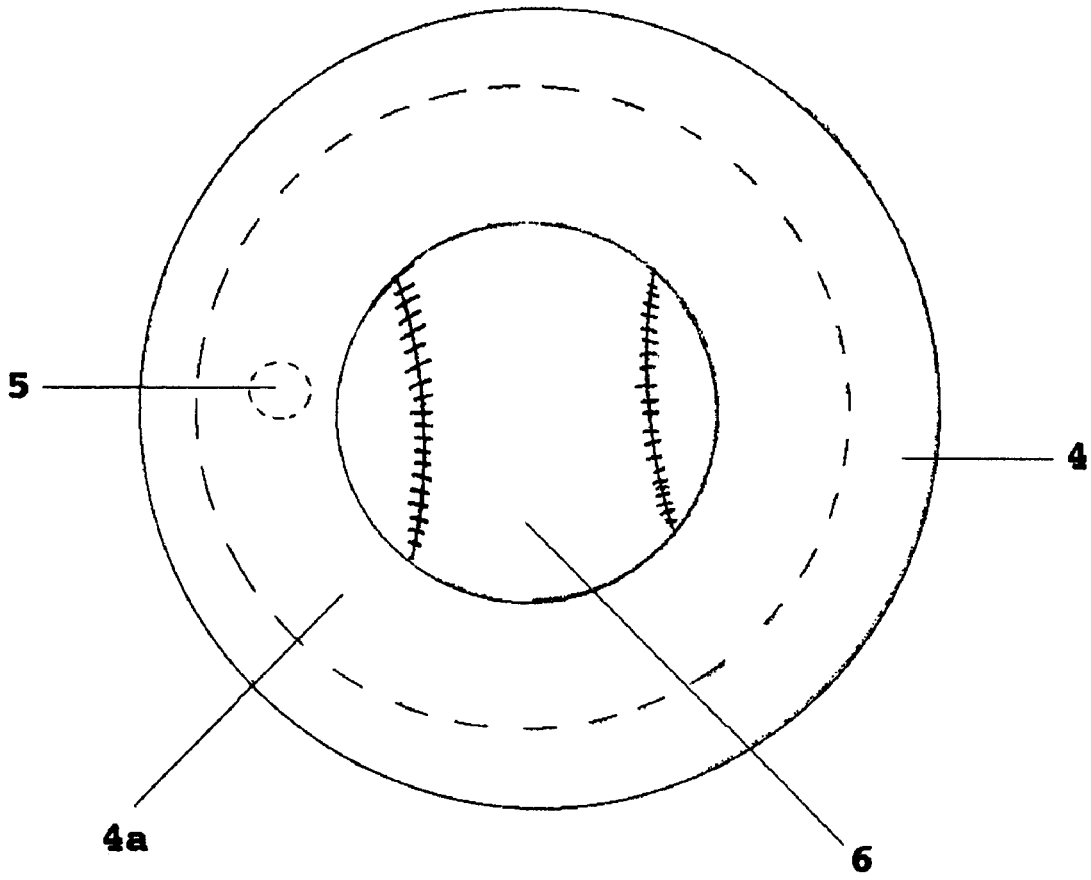

An additional embodiment of the invention is depicted in FIGS. 11 and 12. In this embodiment, the top end 4 of the main body of the apparatus 1 is proportionately longer than the corresponding bottom end. The top end 4 bears a flange 15 to provide further leverage for the signing player's gripping fingers. Also the lip 4*c* of both the top end 4 and the bottom end 4*a* flare outwardly at an angle of 15° to the flat upper surface of each end. The bottom end 4*a* of the main body of the apparatus 1 is asymmetrically concavely curved, flattening out to become parallel with the top end 4. At the end underneath the flange 15 on the top end 4, an additional flange 16 is provided to give further leverage to the autographing player while signing the article of sports memorabilia 6. Parallel to the hole 5 in the top end 4 of the main body of the apparatus 1, a cylindrical holder 17 to accept a writing implement 7 arises upwardly towards the top end 4. This holder 17 may be formed directly from the material forming the body of the bottom end 4*a*, or otherwise affixed to this material. Also, the holder 17 may be at a slight angle to the top end 4, such as a −2°, rather than rising perpendicularly upwardly. As evident in FIG. 11, the top end 4 of the main body of the apparatus 1 projects laterally outwardly from the hole 5 accepting the writing implement 7 a distance greater than the distance of the bottom end 4*a* projecting laterally outwardly from the edge of the holder 17. Also, only the upper portion of the baseball 6 or other article of sports collectible memorabilia is visible, projecting outwardly from the top end 4. In an undepicted embodiment, however, the baseball 6 may project slightly from the bottom end, and in yet another undepicted embodiment, one edge of the top end 4 may be slightly bezeled to allow the apparatus to stand on this end for display purposes.

Figure 13:
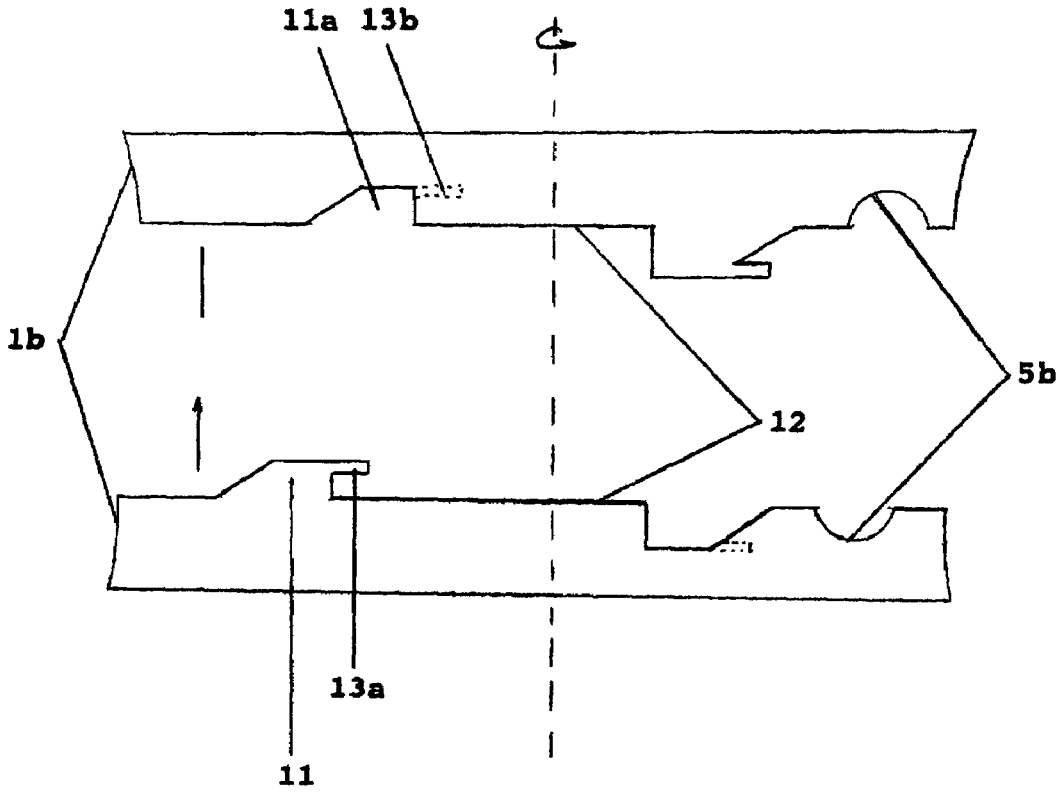
FIG. 13 shows an exploded cross-sectional view of an alternative embodiment of the apparatus, wherein the main body of the apparatus is constructed out of two interlocking pieces.
Figure 14:
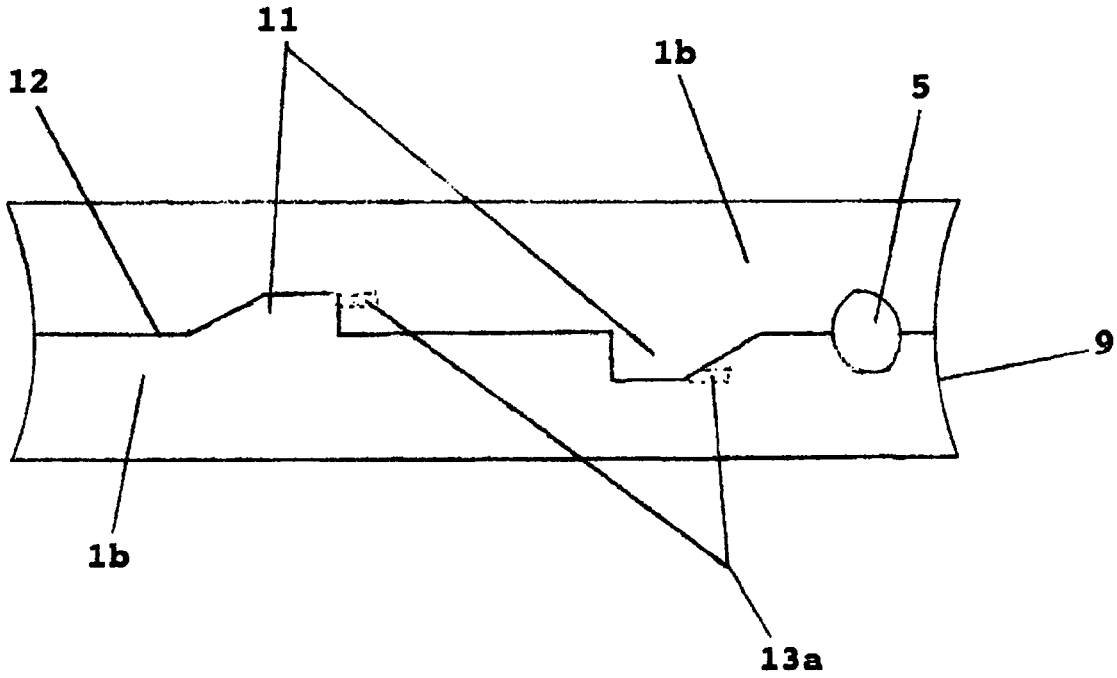
FIG. 14 shows a cross-sectional view of an alternative embodiment of the apparatus, wherein the two interlocking pieces of the main body of the apparatus have been united.

A two-piece alternative embodiment of the apparatus 1 is depicted in FIGS. 13 and 14. The shape of this two-piece embodiment can assume the shape of any of the embodiments previously described; in these illustrations, the embodiment from FIGS. 3 and 4 has been used. Each piece 1*b* of the apparatus 1 is formed at the splitting along the horizontal equator 12 of the apparatus 1 at the midpoint of its height, thereby forming two symmetric pieces 1*b*. Where the embodiment utilizing two bottom flanges 10 is to be used, the apparatus 1 is still to be split along the equator 12 of the apparatus 1 at the midpoint of its height. Each piece 1*b* bears a depression 5*b* at the equatorial edge 12 which, when the pieces are united, will form the hole 5 through which a writing implement may be inserted. Arising from the equatorial edge 12, one or a plurality of locking flanges 11 each bearing a locking arm 13*a* project upwardly. The locking flange 11 and locking arm 13*a* of one piece 1*b* are to be fitted into complementary spaces 11*a* and 13*b* in the other piece. The two pieces 1*b* may be locked into place by turning them clockwise to affixing the locking arms 13*a* tightly into place in the locking arm space 13*b*.

The main advantage of the two-piece design depicted in FIGS. 13 and 14 over a uniform or molded design is twofold: the two-piece design permits the apparatus 1 to be reused with more than one desired piece of memorabilia, and also the apparatus 1 may be removed to permit the collector to store or view the piece of memorabilia in more conventional means. The uniform or molded design is instead contemplated to be permanently molded onto a piece of memorabilia.

Figure 15:
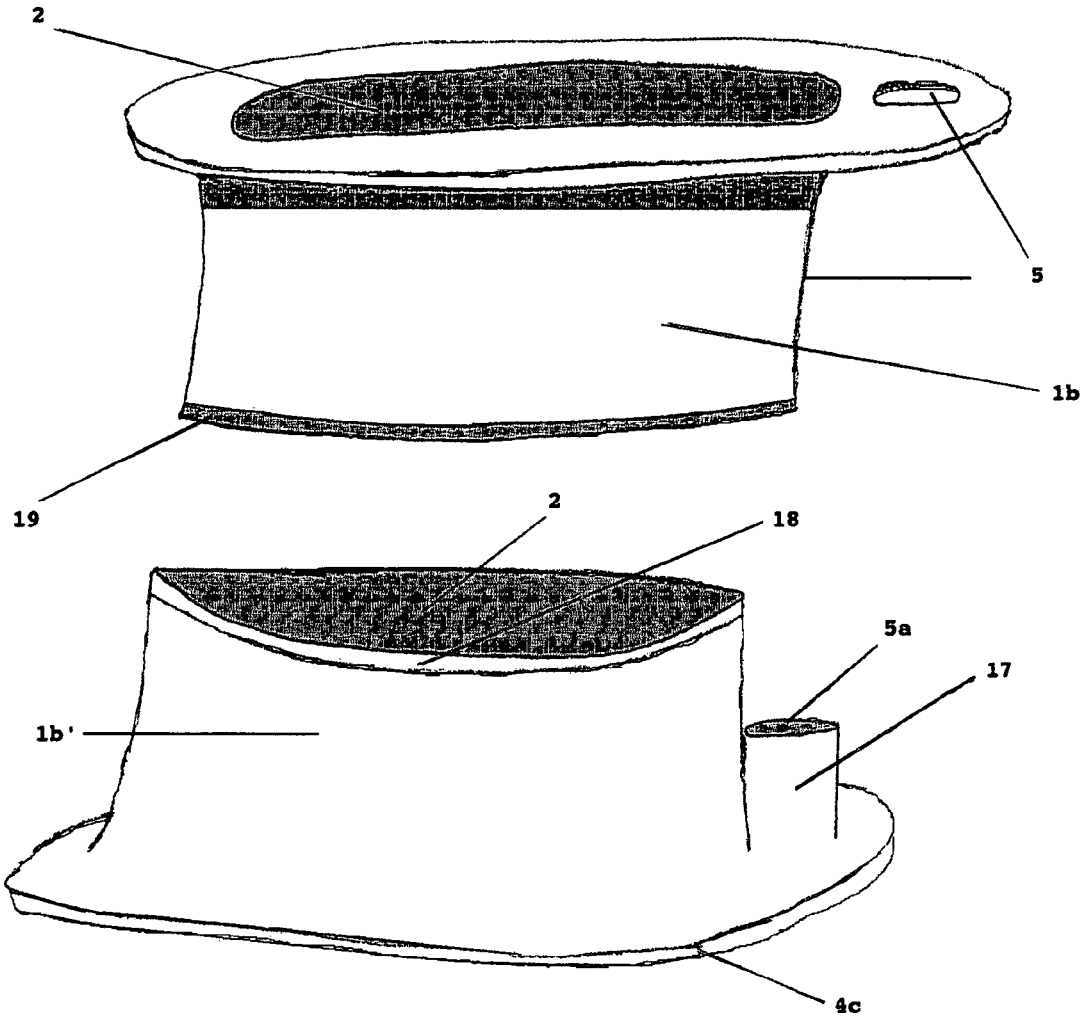
FIGS. 15 and 16 show a front perspective and cross-sectional close-up view, respectively, of the apparatus embodied in FIGS. 11 and 12, now in a two-piece design bearing a tongue-and-groove locking system.
Figure 16:
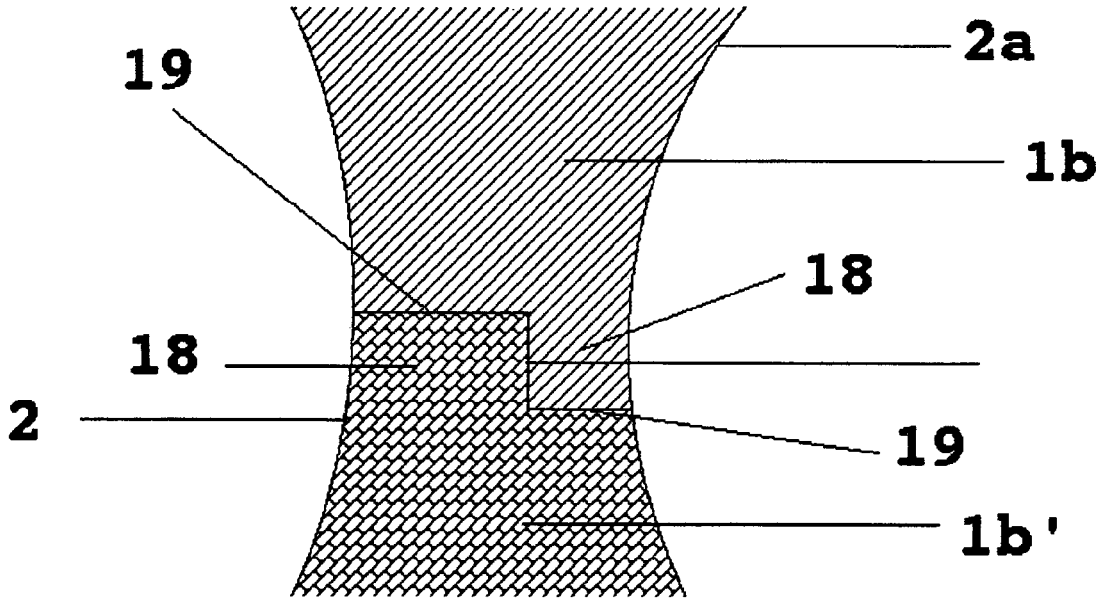

The two-piece embodiment may also bear a simple tongue-and-groove design, without locks, as illustrated in FIGS. 15 and 16. In this embodiment, a tongue 18, projecting outwardly downwardly from the inner edge of one piece 1*b* of the main body of the body of the apparatus 1, is to be inserted into a complementary groove 19 placed along the inner edge of the second piece 1*b*' of the main body of the apparatus 1. A corresponding tongue 18' and groove 19' are also on the second piece 1*b*'. While not as strong as the interlocking design depicted in FIGS. 10 and 11, this form is less expensive to manufacture and is easier to use by older collectors, who may lack the strength or dexterity to grip and rotate the pieces while locking the apparatus around the article of sports memorabilia.

Figure 17:
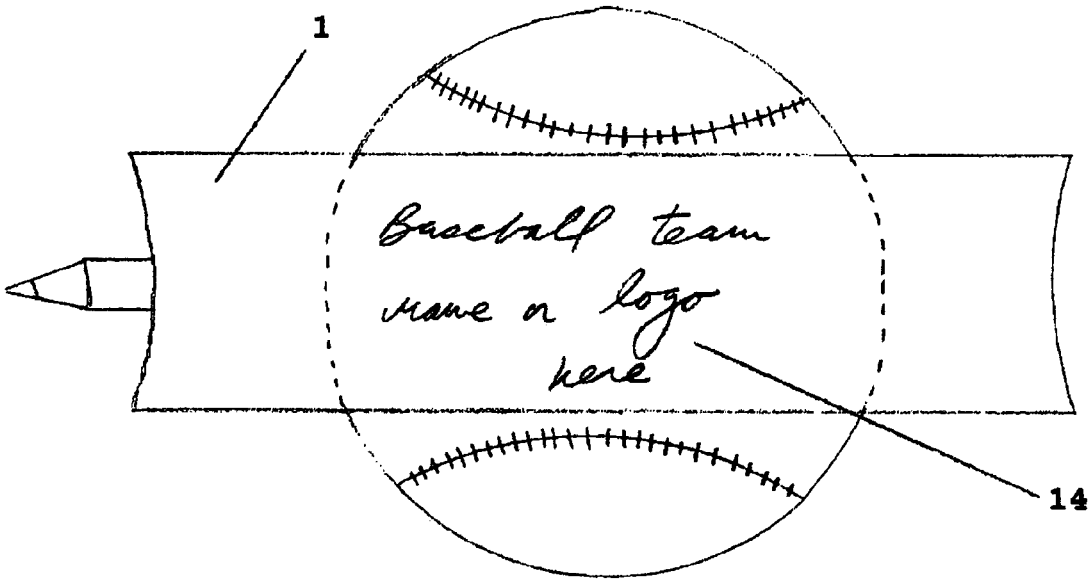
FIG. 17 shows a side view of an alternative embodiment of the apparatus with a baseball inserted therein, this embodiment bearing lettering on the central portion of the main body of the apparatus.

Turning to FIG. 17, the apparatus 1 may also bear graphical information like lettering 14 or logos for advertising, identification, or other informational uses on the central portion 2 or on the top 4 or bottom 4*a* ends (not pictured). Such graphical information may be printed, etched, embossed from the molded plastic of the apparatus 1, or by any other means known to practitioners in the art.

Figure 18:
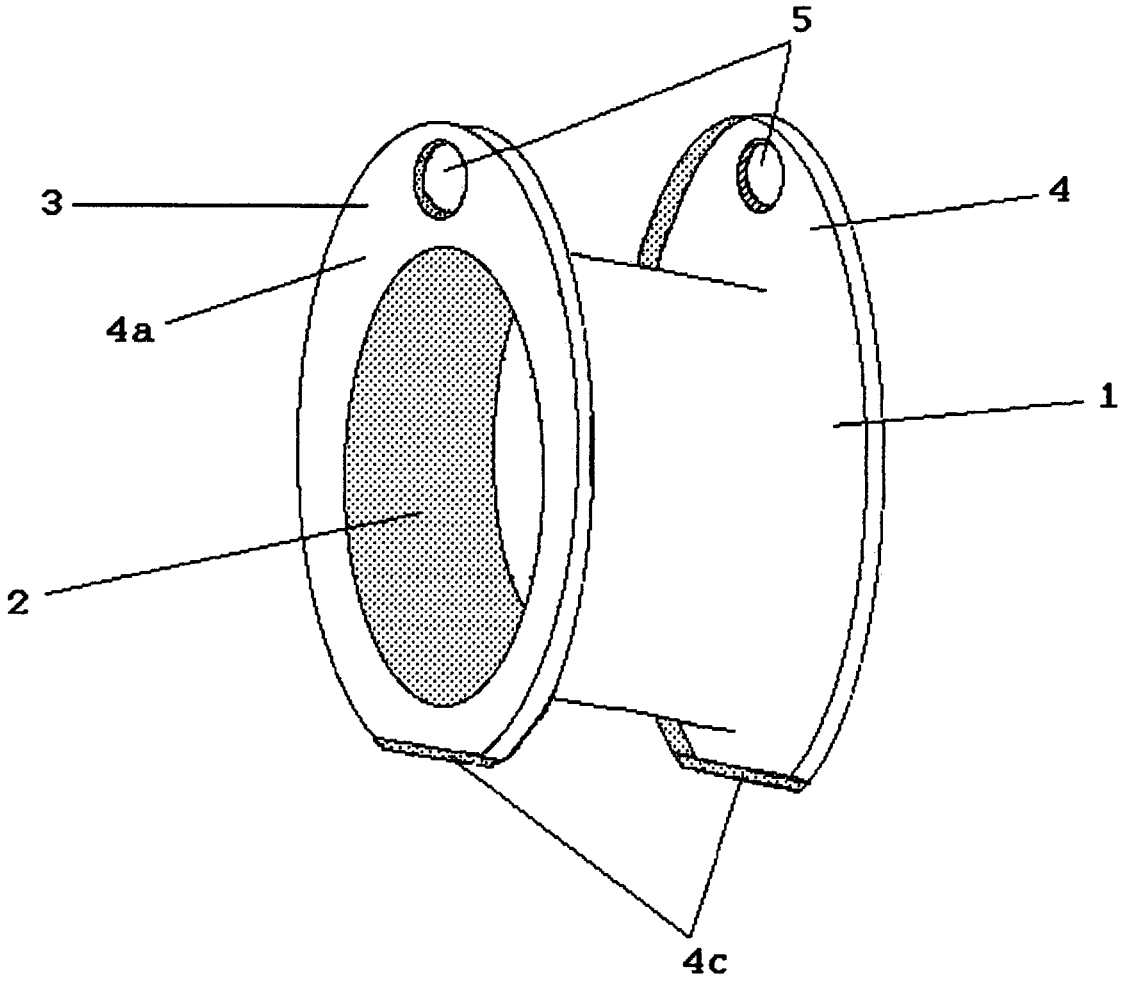
FIG. 18 shows an oblique rear view of an alternative embodiment of the apparatus, bearing angled lips along each lateral flange and having a holder for a writing implement rise from the bottom end at an angle to the top end.

Finally, in FIG. 18, the apparatus 1 is depicted as suggested in FIG. 5, having the lips 4*c* of both the top end 4 and the bottom end 4*a* flare outwardly at an angle of 15° to the flat upper surface of each end and having the hole 5 for the writing implement 7 at a slight angle, such as at −2°, from the top end 4 to the bottom end 4*a*.

The apparatus 1 described herein was designed and manufactured to fit a baseball 6 of Major League Baseball specifications. However, it is contemplated that other types of balls from such different sports as tennis, cricket, hurling, lacrosse, handball, and softball, and other pieces of sports equipment such as hockey pucks are also capable of being signed and fitted into the apparatus 1 in this manner. Furthermore, while an exemplary design has been expressed herein, others practiced in the art may be aware of other designs which may be used to lock the two-piece design into place, and so on. Thus, while the present invention has been described in connection with exemplary embodiments thereof, it will be understood that many modifications in both design and use will be apparent to those of ordinary skill in the art, and this application is intended to cover any adaptations or variations thereof. It is therefore manifestly intended that this invention be limited only by the claims and the equivalents thereof.

The invention claimed is:

1. An apparatus to be used to aid in the signing and protection of a baseball or other appropriately-sized article of sports memorabilia while on the field of play, comprising:

a main body of the apparatus, comprising:

a central portion hollowed out to form a space to accept a baseball or other appropriately sized sports memorabilia article, said central portion having two flanges project outwardly laterally, said central portion and lateral flanges having top and bottom ends extending the entire length of the central portion and the lateral flanges, said top and bottom ends each bearing a slight lip;

and a hole drilled through the main body to accept a writing implement.

2. The apparatus of claim 1, wherein the apparatus is constructed from plastic.

3. The apparatus of claim 1, wherein the top and bottom ends of the main body of the apparatus are circular in shape.

4. The apparatus of claim 1, wherein the hollowed-out space in the central portion of the main body of the apparatus has a circumference of no less than 9 inches (") and no greater than 9.25".

5. The apparatus of claim 4, wherein the top and bottom ends of the main body of the apparatus have a circumference greater than that of the hollowed-out space.

6. The apparatus of claim 1, wherein the lateral flanges of the central portion are tapered concavely at their outer edges.

7. The apparatus of claim 6, wherein the bottom end of the apparatus is to remain parallel with the top end along their entire length.

8. The apparatus of claim 6, wherein the bottom end of the apparatus is tapered concavely inwardly towards the top end, thereby defining two bottom flanges projecting outwardly downwardly from the lateral flanges.

9. The apparatus of claim 8, wherein the total height of the apparatus remains as that in claim 7.

10. The apparatus of claim 1, wherein the hole for the writing implement is drilled through one of the lateral flanges.

11. The apparatus of claim 1, wherein the hole for the writing implement is drilled through the top and bottom ends and the central portion of the main body of the apparatus.

12. The apparatus of claim 1, further comprising graphical information provided on the central portion or on the top or bottom ends of the main body of the apparatus.

13. The apparatus of claim 12, wherein the graphical information to be provided on the apparatus is so provided from means selected from a group consisting of printing, etching, or embossing from the molded plastic of the apparatus.

14. A method of aiding in the signing and protection of a baseball or other appropriately-sized article of sports memorabilia article while on the field of play, comprising inserting the article into the hollowed-out space of the central portion of the main body of the apparatus of claim 1 and gripping the lateral flanges or the top and bottom ends of the apparatus while signing.

15. The apparatus of claim 8, wherein the bottom flanges project outwardly at an angle of 15°.

16. The apparatus of claim 11, wherein the hole for the writing implement is drilled at a −2° angle through the top and bottom ends of the apparatus.

17. An apparatus to be used to aid in the signing and protection of a baseball or other appropriately-sized article of sports memorabilia while on the field of play, comprising:

two symmetric pieces of the main body of the apparatus, said symmetric pieces being formed from the division of the main body of the apparatus along its horizontal equator, each symmetric piece comprising a central portion hollowed out to form a space to accept a baseball or other appropriately sized sports memorabilia, said central portion having two flanges project outwardly laterally, said central portion and lateral flanges having an outer and equatorial edges extending the entire length of the central portion and the lateral flanges;

a depression at the equatorial edge which, when the symmetric pieces are united, forms a hole through which a writing implement may be inserted;

a plurality of locking flanges projecting upwardly from the equatorial edge, each locking flange bearing a locking arm;

and a plurality of complementary locking spaces into which each locking flange from the other symmetric piece is inserted, each locking space having a locking arm space into which each locking arm may be inserted.

18. The apparatus of claim 17, wherein the apparatus is constructed from plastic.

19. The apparatus of claim 17, wherein the outer edge of each symmetric piece is circular in shape.

20. The apparatus of claim 17, wherein the hollowed-out space in the central portion of each symmetric piece has a circumference of no less than 9" and no greater than 9.25".

21. The apparatus of claim 20, wherein the outer edge of each symmetric piece has a circumference greater than that of the hollowed-out space.

22. The apparatus of claim 17, wherein the lateral flanges of the central portion of each symmetric piece are tapered concavely at their outer edges.

23. The apparatus of claim 22, wherein the outer edge of one symmetric piece is to remain parallel with the outer edge of the other symmetric piece along their entire length.

24. The apparatus of claim 22, wherein the outer edge of one symmetric piece is tapered concavely inwardly relative to the outer edge of the other symmetric piece, thereby defining two bottom flanges projecting outwardly downwardly from the lateral flanges.

25. The apparatus of claim 24, wherein the total height of the apparatus remains as that in claim 22.

26. The apparatus of claim 17, wherein the hole for the writing implement is drilled through the outer and equatorial edges of each symmetric piece.

27. The apparatus of claim 17, further comprising graphical information provided on the central portion or on the outer edges of the symmetric pieces.

28. The apparatus of claim 17, wherein the graphical information to be provided on the apparatus is so provided from means selected from a group consisting of printing, etching, or embossing from the molded plastic of the apparatus.

29. A method of aiding in the signing and protection of a baseball or other appropriately-sized article of sports memorabilia while on the field of play, comprising:

inserting the article into the hollowed-out space of the central portion of one of the symmetric pieces of the main body of the apparatus of claim 17;

sliding the other symmetric piece over the article and engaging the locking arms on the locking flanges into the locking arm spaces in the complementary locking spaces, thereby locking the symmetric pieces into the single unitary apparatus;

and gripping the lateral flanges or the top and bottom ends of the apparatus while signing.

30. The apparatus of claim 24, wherein the bottom flanges project outwardly at an angle of 15°.

31. The apparatus of claim 26, wherein the hole for the writing implement is drilled at a −2° angle through the outer and equatorial edges of each symmetric piece.

32. An apparatus to be used to aid in the signing and protection of a baseball or other appropriately-sized article of sports memorabilia while on the field of play, comprising:

top and bottom pieces of the main body of the apparatus having outer and upper edges formed from the division of the main body of the apparatus along its horizontal equator, said top and bottom pieces each having a tongue and corresponding groove along its horizontal equator and a central portion hollowed out to form a space to accept the article, said top and bottom pieces also each flaring outwardly laterally along their outer edges at an angle to their upper edges, said top piece further having a flange projecting outwardly laterally from one end situated 180° from a hole drilled through the body of the top piece to accept a writing implement, said bottom piece being asymmetrically concavely curved relative to the top piece, said bottom piece further having a flange projecting outwardly laterally from one end directly underneath the flange of the top piece situated 180° from a cylindrical holder piece to accept a writing implement, said holder piece rising upwardly towards the hole in the top piece.

33. The apparatus of claim 32, wherein the apparatus is constructed from plastic.

34. The apparatus of claim 32, wherein the outer edge of the top and bottom pieces is circular in shape.

35. The apparatus of claim 32, wherein the hollowed-out space in the central portion of the top and bottom pieces has a circumference of no less than 9" and no greater than 9.25".

36. The apparatus of claim 35, wherein the outer and upper edges of the top and bottom pieces have a circumference greater than that of the hollowed-out space.

37. The apparatus of claim 32, wherein the cylindrical holder is formed from the upper surface of the bottom piece.

38. The apparatus of claim 32, wherein the cylindrical holder is a separate component affixed to the upper surface of the bottom piece.

39. The apparatus of claim 32, wherein the cylindrical holder rises perpendicularly upwardly towards the hole in the top piece.

40. The apparatus of claim 32, wherein the cylindrical holder rises at an angle to the hole in the top piece.

41. The apparatus of claim 32, further comprising graphical information provided on the central portion, on the upper edge of the top piece, or on the outer edges of the top and/or bottom pieces.

42. The apparatus of claim 41, wherein the graphical information to be provided on the apparatus is so provided from means selected from a group consisting of printing, etching, or embossing from the molded plastic of the apparatus.

43. A method of aiding in the signing and protection of a baseball or other appropriately-sized article of sports memorabilia while on the field of play, comprising:

inserting the article into the hollowed-out space of the central portion of one of the symmetric pieces of the main body of the apparatus of claim 32;

depressing the top and bottom pieces of the main body of the apparatus together such that the tongues on the top and bottom pieces enter the complementary grooves on the top and bottom pieces;

and gripping the lateral flanges or the top and bottom ends of the apparatus while signing.

44. The apparatus of claim 32, wherein the top and bottom pieces flare outwardly laterally along their outer edges at a 15° angle to their upper edges.

45. The apparatus of claim 40, wherein the angle is −2°.

* * * * *

UNITED STATES PATENT AND TRADEMARK OFFICE

CERTIFICATE OF CORRECTION

PATENT NO. : 7,445,118 B2
APPLICATION NO. : 10/553701
DATED : November 4, 2008
INVENTOR(S) : James Schroeder It is certified that error appears in the above-identified patent and that said Letters Patent is hereby corrected as shown below:

Title page, item (54): “SIGNALING” should be changed to --SIGNING--

Column 1, Line 1: “SIGNALING” should be changed to --SIGNING--

Signed and Sealed this

Seventeenth Day of February, 2009

JOHN DOLL
*Acting Director of the United States Patent and Trademark Office*